US006889423B2

(12) United States Patent
Sakakura et al.

(10) Patent No.: US 6,889,423 B2
(45) Date of Patent: May 10, 2005

(54) METHOD FOR MANUFACTURING LAMINATED ELECTRONIC COMPONENT

(75) Inventors: Mitsuo Sakakura, Tamagawa-Mura (JP); Seiichi Kobayashi, Tamagawa-Mura (JP); Tadayoshi Nagasawa, Tamagawa-Mura (JP); Yutaka Noguchi, Tamagawa-Mura (JP); Hiroyasu Mori, Tamagawa-Mura (JP)

(73) Assignee: Toko Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/679,299

(22) Filed: Oct. 7, 2003

(65) Prior Publication Data

US 2004/0046631 A1 Mar. 11, 2004

Related U.S. Application Data

(62) Division of application No. 10/079,909, filed on Feb. 22, 2002, now Pat. No. 6,727,795.

(30) Foreign Application Priority Data

Feb. 23, 2001 (JP) ..... 2001-048094

(51) Int. Cl.[7] ..... H01F 7/06
(52) U.S. Cl. ..... 29/602.1; 336/200; 156/277
(58) Field of Search ..... 336/83, 200, 206–208, 336/232; 29/602.1; 156/272.2, 272.8, 277

(56) References Cited

U.S. PATENT DOCUMENTS 5,184,103 A 2/1993 Gadreau et al. ..... 336/84 C
5,850,682 A * 12/1998 Ushiro ..... 29/608
6,133,809 A 10/2000 Tomohiro et al. ..... 333/185
6,198,374 B1 3/2001 Abel ..... 336/200
6,293,001 B1 9/2001 Uriu et al. ..... 29/608
6,504,466 B1 * 1/2003 Katsurada ..... 336/200
6,515,568 B1 * 2/2003 Maki et al. ..... 336/200
6,630,881 B1 * 10/2003 Takeuchi et al. ..... 336/200
6,692,609 B2 * 2/2004 Kobayashi et al. ..... 156/272.8

FOREIGN PATENT DOCUMENTS

JP 05-190367 * 7/1993
JP 11-260643 9/1999
JP 20011076929 A 3/2001

* cited by examiner

*Primary Examiner*—Tuyen T. Nguyen
(74) *Attorney, Agent, or Firm*—Pillsbury Winthrop LLP

(57) ABSTRACT

A laminated electronic component comprising: a plurality of parallel first conductive patterns, which are laminated via a magnetic layer to a plurality of parallel second conductive patterns, the first and second conductive patterns being alternately connected to each other via through-holes, thereby forming a spiral coil inside a laminated body, the axis of the spiral coil being parallel to a mount face; wherein the magnetic layer, provided between the plurality of first conductive patterns and the plurality of second conductive patterns, comprises non-magnetic sections which are provided at positions corresponding to ends of the conductive patterns and extend parallel to the axis of the coil, and a method for manufacturing the same.

9 Claims, 6 Drawing Sheets

METHOD FOR MANUFACTURING LAMINATED ELECTRONIC COMPONENT

CROSS-REFERENCE TO RELATED APPLICATIONS

This is a Divisional Application of U.S. application Ser. No. 10/079,909, filed Feb. 22, 2002, now U.S. Pat No. 6,727,795, which claims priority from the prior Japanese Patent Application No. 2001-048094, filed Feb. 23, 2001, the entire contents both of which are incorporated herein by reference.

BACKGROUND OF THE INVENTION

1. Field of the Invention

The present invention relates to a laminated electronic component comprising a plurality of parallel first conductive patterns, laminated to a plurality of parallel second conductive patterns with a magnetic layer therebetween, the first and second conductive patterns being alternately connected to each other via through-holes, and thereby forming a spiral coil inside the laminated body, with the axis of the spiral coil being parallel to the mount face, and also relates to a method for manufacturing the laminated electronic component.

2. Description of the Related Art

FIG. 7 shows one example of a conventional laminated electronic component which is comprised by laminating a magnetic layer 71A, which a plurality of parallel conductive patterns 72A are provided on, a magnetic layer 71B, which a plurality of parallel conductive patterns 72B are provided on, and a magnetic layer for protection 71C, and alternately connecting the conductive patterns 72A and 72B. The conductive patterns 72A and 72B of the laminated electronic component constitute a spiral coil inside the laminated body, the axis of the spiral coil being parallel to the mount face.

As shown in FIGS. 8A and 8B, since the conductive patterns which form the spiral coil are surrounded by magnetic material, this type of laminated electronic component does not achieve an ideal distribution of magnetic flux, shown by reference codes $\phi$1 and $\phi$2, and consequently, there is leakage of flux at $\phi$A and $\phi$B. For this reason, such conventional laminated electronic components have poor magnetic coupling and cannot obtain a large inductance.

SUMMARY OF THE INVENTION

It is an object of this invention to provide a laminated electronic component which has no leakage flux and can obtain a large inductance, and a method for manufacturing the laminated electronic component.

The laminated electronic component according to this invention achieves the above objects by forming a non-magnetic material so that the outside of a spiral coil pattern, may be surrounded.

The laminated electronic component according to this invention comprises a plurality of parallel first conductive patterns, which are laminated via a magnetic layer to a plurality of parallel second conductive patterns, the first and second conductive patterns being alternately connected to each other via through-holes, thereby forming a spiral coil inside a laminated body, the axis of the spiral coil being parallel to a mount face. The magnetic layer, provided between the plurality of first conductive patterns and the plurality of second conductive patterns, comprises non-magnetic sections which are provided at positions corresponding to ends of the conductive patterns and extend parallel to the axis of the coil.

This invention provides a method for manufacturing the laminated electronic component comprising a plurality of parallel first conductive patterns, which are laminated via a magnetic layer to a plurality of parallel second conductive patterns, the first and second conductive patterns being alternately connected to each other via through-holes, thereby forming a spiral coil inside a laminated body, the axis of the spiral coil being parallel to a mount face. The method comprises a first step of printing a plurality of first conductive patterns in parallel on a top face of a first non-magnetic layer on a first magnetic layer; a second step of providing a second magnetic layer over the entire top face of the first non-magnetic layer, which the first conductive patterns are provided on, and providing a pair of grooves at positions corresponding to ends of the first conductive patterns on the second magnetic layer by laser processing, the pair of grooves extending parallel to the axis of the coil; a third step of providing non-magnetic sections having through-holes at positions corresponding to the ends of the first conductive patterns in the pair of grooves; a fourth step of printing a plurality of second conductive patterns on the top face of the second magnetic layer, which the non-magnetic sections are provided on, the plurality of second conductive patterns being arranged in parallel so that the first conductive patterns are alternately connected thereto via the through-holes, thereby forming a spiral coil pattern; and a fifth step of sequentially providing a second non-magnetic layer and a third magnetic layer on the second magnetic layer, which the non-magnetic sections and the second conductive patterns are provided on.

Further, the method for manufacturing a laminated electronic component comprising a plurality of parallel first conductive patterns, which are laminated via a magnetic layer to a plurality of parallel second conductive patterns, the first and second conductive patterns being alternately connected to each other via through-holes, thereby forming a spiral coil inside a laminated body, the axis of the spiral coil being parallel to a mount face, comprises a first step of printing a plurality of first conductive patterns in parallel on a top face of a first non-magnetic layer on a first magnetic layer; a second step of providing a plurality of second magnetic layers over the entire top face of the first non-magnetic layer, which the first conductive patterns are provided on, and providing a pair of grooves at positions corresponding to ends of the first conductive patterns on the second magnetic layer by laser processing, the pair of grooves extending parallel to the axis of the coil; a third step of providing non-magnetic sections having through-holes at positions corresponding to the ends of the first conductive patterns in the pair of grooves; a fourth step of printing a plurality of second conductive patterns on the top face of the second magnetic layer, which the non-magnetic sections are provided on, the plurality of second conductive patterns being arranged in parallel so that the first conductive patterns are alternately connected thereto via the through-holes, thereby forming a spiral coil pattern; and a fifth step of sequentially providing a second non-magnetic layer and a third magnetic layer on the second magnetic layer, which the non-magnetic sections and the second conductive patterns are provided on.

Further, the method for manufacturing a laminated electronic component comprising a plurality of parallel first conductive patterns, which are laminated via a magnetic layer to a plurality of parallel second conductive patterns, the first and second conductive patterns being alternately connected to each other via through-holes, thereby forming a spiral coil inside a laminated body, the axis of the spiral coil being parallel to a mount face, comprises a first step of printing a plurality of first conductive patterns in parallel on a top face of a first non-magnetic layer, which is provided on a first magnetic layer; a second step of providing a plurality of second magnetic layers having non-magnetic sections by repeatedly performing the sequential processes of providing a second magnetic layer over the entire top face of the first non-magnetic layer, which the first conductive patterns are provided on, providing a pair of grooves at positions corresponding to ends of the first conductive patterns on the second magnetic layer by laser processing, the pair of grooves extending parallel to the axis of the coil, providing non-magnetic sections having through-holes at positions corresponding to the ends of the first conductive patterns in the pair of grooves, and filling the through-holes with conductive material; a third step of printing a plurality of second conductive patterns on the top face of the second magnetic layers having the non-magnetic sections, the plurality of second conductive patterns being arranged in parallel so that the first conductive patterns are alternately connected thereto via the through-holes, thereby forming a spiral coil pattern; and a fourth step of sequentially providing a second non-magnetic layer and a third magnetic layer on the second magnetic layer, which the non-magnetic sections and the second conductive patterns are provided on.

According to the method for manufacturing a laminated electronic component of this invention, a surface to mount a mask for printing a non-magnetic paste and a conductive paste can be flat, because a pair of grooves extending in the direction parallel to the axis of a coil is formed by laser processing at the positions corresponding to the both ends of a first conductive pattern of a second magnetic layer after forming the second magnetic layer over the entire top faces of the first non-magnetic layer on which the conductive patterns are provided. Further, through-holes are formed at positions corresponding to the ends of the first conductive pattern of the non-magnetic layer precisely, and the sizes of the through-holes can be minimized, because laser processing of the through-holes does not result any blur in the case of printing.

DESCRIPTION OF THE PREFERRED EMBODIMENTS

Embodiments of the laminated electronic component and manufacturing method according to this invention will be explained with reference to FIGS. 1 to 6.

Figure 1:
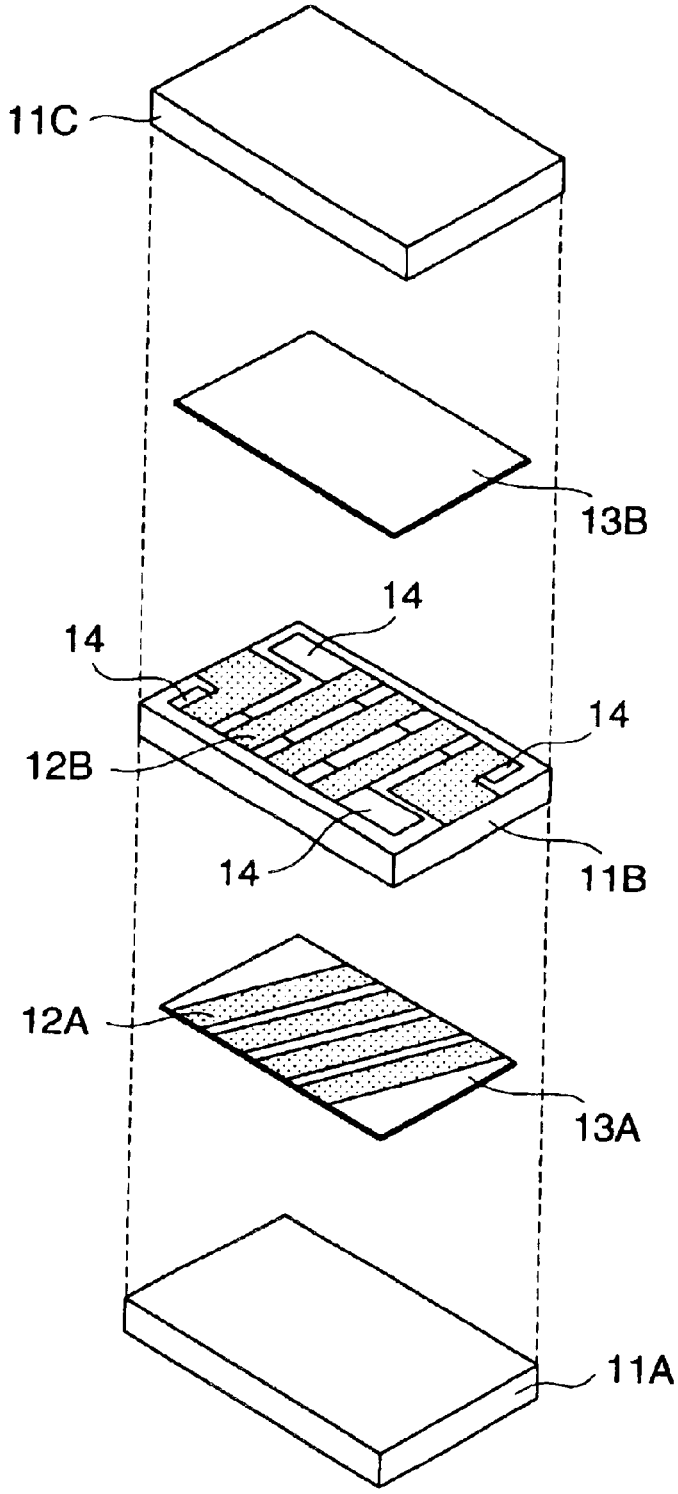
FIG. 1 is an exploded perspective view of a first embodiment of the laminated electronic component of this invention.
Figure 2:
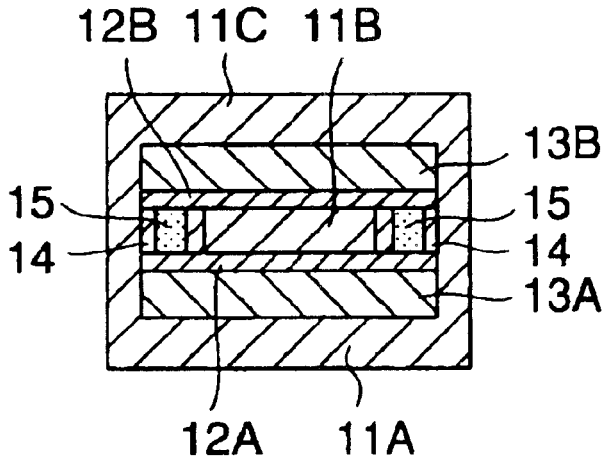
FIG. 2 is a cross-sectional view of FIG. 1.
Figure 3:
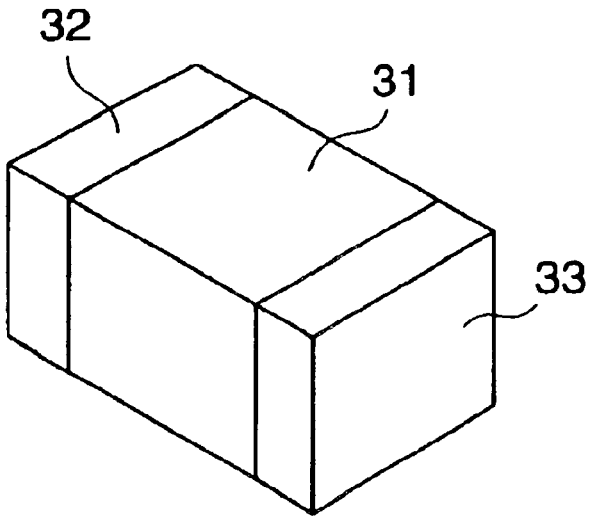
FIG. 3 is a perspective view of the laminated electronic component of this invention.

FIG. 1 is an exploded perspective view of a first embodiment of the laminated electronic component of this invention, FIG. 2 is a cross-sectional view of FIG. 1, and FIG. 3 is a perspective view of the laminated electronic component of this invention.

In FIGS. 1 and 2, reference codes 11A, 11B, and 11C represent magnetic layers, 12A and 12B represent conductive patterns, and 13A and 13B represent non-magnetic layers.

The magnetic layers 11A, 11B, and 11C comprise magnetic material, such as spinel ferrite, hexagonal ferrite and the like. The non-magnetic layers comprise non-magnetic material having insulating properties, such as a glass, non-magnetic ceramic and the like.

The non-magnetic layer 13A is provided on the top face of the magnetic layer 11A, and has a smaller shape than the magnetic layer 11A. A plurality of conductive patterns 12A are provided in parallel on the top face of the non-magnetic layer 13A. The long sides of the conductive patterns 12A extend to the width of the non-magnetic layer 13A. The plurality of conductive patterns 12A are separated at predetermined intervals, and arranged along the long side of the non-magnetic layer 13A.

The magnetic layer 11B is provided on the top face of the non-magnetic layer 13A, which the plurality of conductive patterns 12A are provided on. Non-magnetic sections 14 are provided on the magnetic layer 11B at positions corresponding to the ends of the conductive patterns 12A, and extend in the arrangement direction of the plurality of conductive patterns (i.e. parallel to the axis of the coil). The non-magnetic sections 14 comprise non-magnetic material having insulating properties, such as glass, non-magnetic ceramic and the like, and their lengths are shorter than the length of the magnetic layer 11B. Through-holes are provided in the non-magnetic sections 14 at a plurality of positions corresponding to the ends of the conductive patterns 12A. The top faces of the non-magnetic sections 14 are the same height as the top face of the magnetic layer 11B.

A plurality of conductive patterns 12B are provided in parallel on the top face of the magnetic layer 11B, which the non-magnetic sections 14 are provided on. Each of the conductive patterns 12B extends to the width of the magnetic layer 11B so as to be connectable to two of the conductive patterns 12A. The ends of the conductive patterns 12B are opposite the ends of the conductive patterns 12A via the non-magnetic sections 14. The plurality of conductive patterns 12B are separated at predetermined intervals, and arranged along the long side of the magnetic layer 11B.

The one end of the conductive patterns 12B and the one end of the conductive patterns 12A connect to each other via conductors 15 in the through-holes of the non-magnetic section 14. The other end of the conductive patterns 12B and the other end of the another conductive patterns 12A connect to each other via conductors 15 in the through-holes of the non-magnetic section 14.

The plurality of conductive patterns 12A, the conductors 15 in the through-holes, and the plurality of conductive patterns 12B, constitute a spiral coil pattern, the axis of the spiral coil being parallel to the mount face.

A non-magnetic layer 13B is provided on the top face of the magnetic layer 11B, where the non-magnetic sections 14 and the plurality of conductive patterns 12B are provided, and has a smaller shape than the magnetic layer 11B. A magnetic layer 11C is provided on the top face of the non-magnetic layer 13B.

As shown in FIG. 3, the ends of the spiral coil, formed inside the laminated body, are extracted at both ends of the laminated body, and connect to outside electrodes 32 and 33, provided at both ends of the laminated body 31.

In the laminated electronic component of this invention having the constitution described above, the outer side of the spiral coil pattern, comprising the conductive patterns 12A, the conductors 15 in the through-holes, and the conductive patterns 12B, is enclosed on all four sides by the non-magnetic layers 13A, 13B and the non-magnetic sections 14; in addition, magnetic paths are formed outside the non-magnetic layers 13A, 13B and the non-magnetic sections 14, and inside the spiral coil pattern.

Figure 4A:
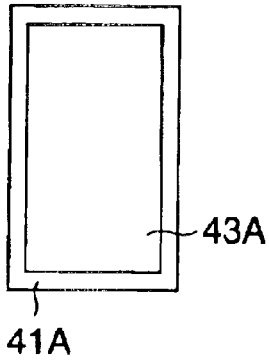
FIGS. 4A to 4I are top views showing a first embodiment of a laminated electronic component manufacturing method of this invention.

The laminated electronic component of this type is made in the following way. Firstly, as shown in FIG. 4A, a non-magnetic layer 43A is provided on the top face of magnetic layer 41A, comprising a magnetic ceramic, such as spinel ferrite and hexagonal ferrite and the like. The non-magnetic layer 43A is made by printing a paste of a non-magnetic ceramic (e.g. dielectric ceramic which contain forsterite) on the top face of the magnetic layer 41A excepting the peripheral portions of the magnetic layer 41A; alternatively, the non-magnetic ceramic (e.g. dielectric ceramic which contain forsterite) is used to laminate a non-magnetic ceramic sheet onto the magnetic layer 41A while exposing the peripheral portion of the magnetic layer 41, the non-magnetic ceramic sheet being smaller than the magnetic layer 41A.

Figure 4B:
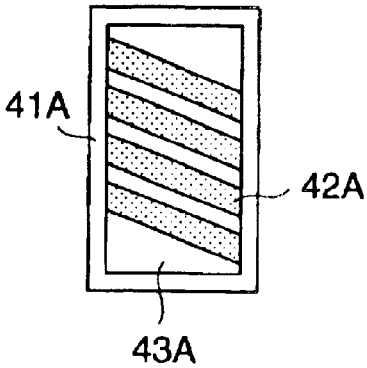

Subsequently, as shown in FIG. 4B, a plurality of conductive patterns 42A are printed in parallel on the top face of the non-magnetic layer 43A. The plurality of the conductive patterns 42A are arranged to the long side of the non-magnetic layer 43A and are separated at predetermined intervals. These conductive patterns are printed by using a dielectric paste of silver, nickel, silver palladium, copper, and the like.

Figure 4C:
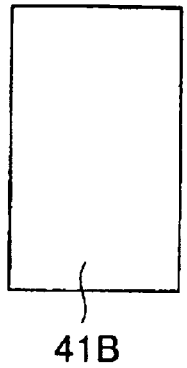

Then, as shown in FIG. 4C, a magnetic layer 41B is provided over the entire top faces of the non-magnetic layer, which the conductive patterns are provided on, and the portion of the magnetic layer which is exposed from the non-magnetic layer. The magnetic layer 41B is provided by printing a paste comprising a magnetic ceramic, such as spinel ferrite, hexagonal ferrite and the like, over the entire top faces of the non-magnetic layer 43A and the portion of the magnetic layer 41A which is exposed from the non-magnetic layer, or alternatively, by using a magnetic ceramic, such as spinel ferrite, hexagonal ferrite and the like, to laminate a magnetic ceramic sheet, which is the same size as the magnetic layer 41A, over the non-magnetic layer 43A.

Figure 4D:
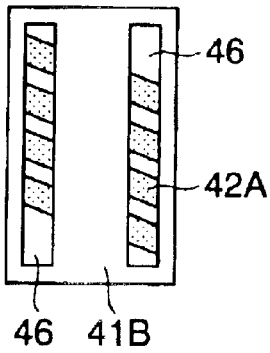

Then, as shown in FIG. 4D, a pair of grooves 46 are provided by laser processing on the magnetic layer 41B at positions corresponding to the ends of the conductive patterns 42A on the magnetic layer 43A so that the grooves 46 extend parallel to the axis of the coil. The pair of grooves 46 are provided by radiating laser light onto the magnetic layer 41B in a direction parallel to the axis of the coil at positions corresponding to the ends of the conductive patterns 42A. The ends of the conductive patterns 42A are exposed at the grooves 46.

Figure 4E:
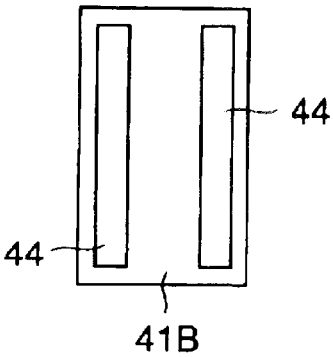

Then, as shown in FIG. 4E, non-magnetic sections 44 are provided in the pair of grooves 46. The non-magnetic sections 44 are provided by printing a paste comprising a non-magnetic ceramic (e.g. dielectric ceramic which contain forsterite), in the entire inside of the grooves 46. The top faces of the non-magnetic sections 44 are the same height as the magnetic layer 41B.

Figure 4F:
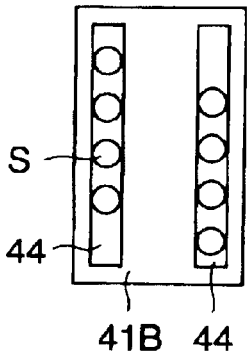

Furthermore, as shown in FIG. 4F, through-holes S are provided by laser processing on the non-magnetic section 44 at positions corresponding to the ends of the conductive patterns on the non-magnetic sections 44.

Figure 4G:
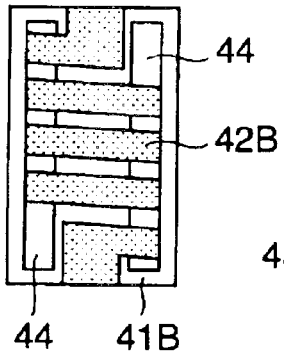

Subsequently, as shown in FIG. 4G, a plurality of conductive patterns 42B are printed in parallel on the magnetic layer 41B, which the non-magnetic sections 44 having these through-holes are provided on. The ends of the plurality of conductive patterns 42B extend to the width of the magnetic layer 41B, so as to allow the two conductive patterns 42A to be connected thereto, and are arranged in a row at predetermined intervals parallel to the long side of the magnetic layer 41B. The plurality of the conductive patterns 42B are arranged so as to be opposite the conductive patterns 42A on the top faces of the non-magnetic sections 44. Conductors are filled into the through-holes at the time of printing the conductive patterns 42B. The one end of each of the conductive patterns 42B to one end of the conductive patterns 42A connect to each other via conductor in the through-hole. The other end of each of the conductive patterns 42B and the other ends of the other conductive patterns 42A connect to each other similarly. The plurality of parallel conductive patterns 42A, the plurality of parallel conductive patterns 42B, and the conductors in the through-holes constitute a spiral coil pattern, the axis of the coil pattern being parallel to the mount surface.

Figure 4H:
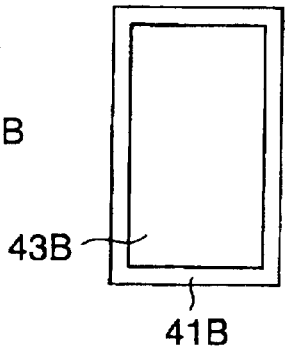

Then, as shown in FIG. 4H, a non-magnetic layer 43B is provided on the top face of the magnetic layer 41B by printing a paste of a non-magnetic ceramic on the top face of the magnetic layer 41B excepting the peripheral portions of the magnetic layer 41B; or alternatively, by using the non-magnetic ceramic to laminate a non-magnetic ceramic sheet onto the magnetic layer 41B while exposing the peripheral portion of the magnetic layer 41, the non-magnetic ceramic sheet being smaller than the magnetic layer 41B.

Figure 4I:
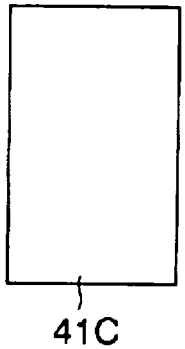

Subsequently, as shown in FIG. 4I, a magnetic layer 41C is provided over the entire top faces of the non-magnetic layer, which the conductive patterns are provided on, and the portion of the magnetic layer which is exposed from the non-magnetic layer. The magnetic layer 41C is provided by printing a paste comprising a magnetic ceramic over the entire top faces of the non-magnetic layer 43B and the portion of the magnetic layer 41B which is exposed from the non-magnetic layer, or alternatively, by using a magnetic ceramic to laminate a magnetic ceramic sheet, which is the same size as the magnetic layer 41B, over the non-magnetic layer 43B.

Then, these laminated bodies are burnt into a single body, ends of the spiral coil pattern are extracted from each end of the laminated body, and outside electrodes are provided thereto.

Incidentally, the type of laser used in forming the pair of grooves and the through-holes should be one which can easily process the respective materials. For example, a $CO_2$ laser or a YAG laser is used in forming the pair of grooves, and the $CO_2$ laser is used in forming the through-holes.

Figure 5:
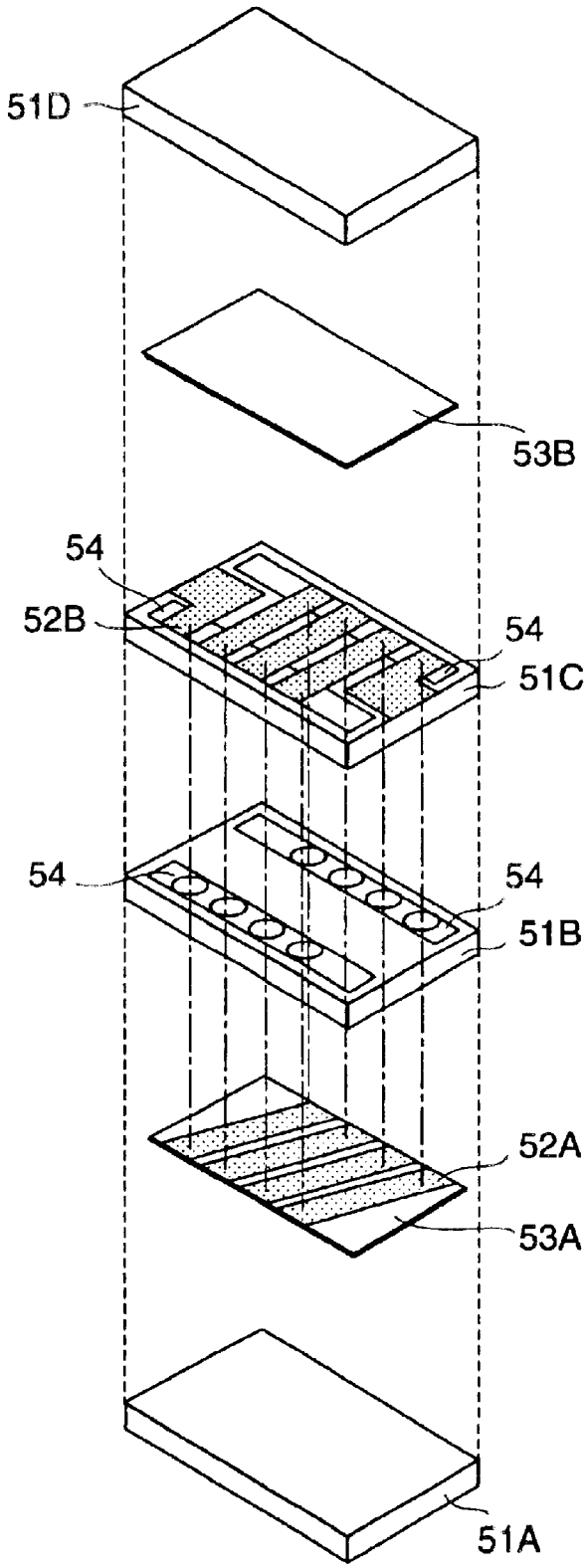
FIG. 5 is an exploded perspective view of a second embodiment of the laminated electronic component manufacturing method of this invention.

FIG. 5 is an exploded perspective view of a second embodiment of the laminated electronic component according to this invention.

A non-magnetic layer 53A is smaller than a magnetic layer 51A, which it is provided on, and a plurality of conductive patterns 52A are provided in parallel on the top face of the non-magnetic layer 53A.

Magnetic layers 51B and 51C are provided on the top face of the non-magnetic layer 53A, which the plurality of conductive patterns 52A are provided on. The magnetic layers 51B and 51C each have non-magnetic sections 54, provided at positions corresponding to the ends of the conductive patterns 52A and extending in the arrangement direction of the plurality of conductive patterns (i.e. parallel to the axis of the coil). Through-holes are provided in the non-magnetic sections 54 at a plurality of positions corresponding to the ends of the conductive patterns 54A.

A plurality of conductive patterns 52B are arranged in parallel on the top face of the magnetic layer 51, which the non-magnetic sections are provided on. Conductors are filled in the through-holes of the non-magnetic sections 54, and connect the conductive patterns 52B to the conductive patterns 52A. The plurality of conductive patterns 52A, the conductors which are filled in the through-holes, and the plurality of conductive patterns 52B, together constitute a spiral coil pattern, the axis of the spiral coil being parallel to the mount face.

A non-magnetic layer 53B is provided on top of the magnetic layer 51C, and is smaller than the magnetic layer 51C. A magnetic layer 51D is provided on the non-magnetic layer 53B.

Figure 6A:
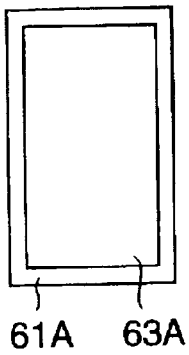
FIGS. 6A to 6H are top views showing a second embodiment of a laminated electronic component manufacturing method of this invention.

The laminated electronic component of this type is made in the following way. Firstly, as shown in FIG. 6A, a non-magnetic layer 63A is provided on the top face of magnetic layer 61A.

Figure 6B:
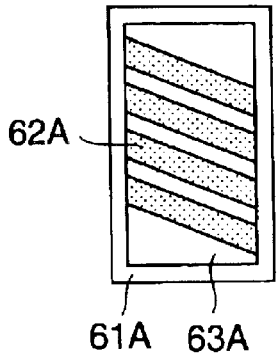

Subsequently, as shown in FIG. 6B, a plurality of conductive patterns 62A are printed in parallel on the top face of the non-magnetic layer 63A.

Figure 6C:
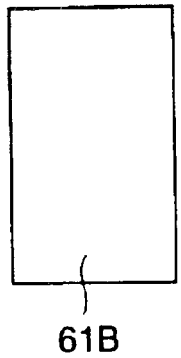

Then, as shown in FIG. 6C, a magnetic layer 61B is provided over the entire top faces of the non-magnetic layer, which the conductive patterns are provided on, and the portion of the magnetic layer which is exposed from the non-magnetic layer. The magnetic layer 61B is provided by printing a paste comprising a magnetic ceramic over the entire top faces of the non-magnetic layer 63A and the portion of the magnetic layer 61A which is exposed from the non-magnetic layer, or alternatively, by laminating a magnetic ceramic sheet, which is the same size as the magnetic layer 61A, over the non-magnetic layer 63A.

Figure 6D:
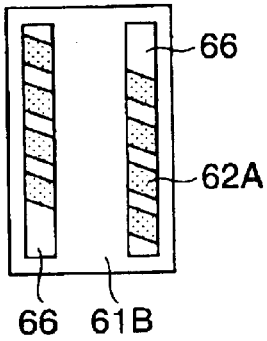

Then, as shown in FIG. 6D, a pair of grooves 66 are provided by laser processing on the magnetic layer 61B at positions corresponding to both ends of the conductive patterns 62A so that the grooves 66 extend parallel to the axis of the coil. The ends of the conductive patterns 62A are exposed at the grooves 66.

Figure 6E:
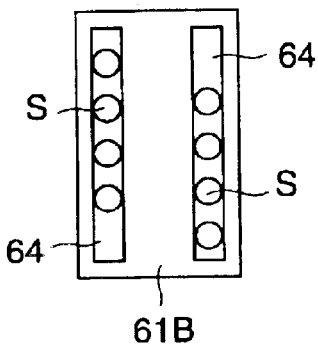

Then, as shown in FIG. 6E, non-magnetic sections 64 are provided in the pair of grooves 66. The non-magnetic sections 64 are provided by printing a non-magnetic ceramic paste in the grooves 66 so that through-holes S are formed at positions corresponding to the ends of the conductive patterns. Conductors are filled in the through-holes S.

Figure 6F:
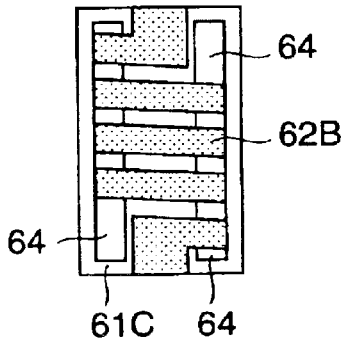

The processes shown in FIGS. 6C to 6E are repeated until the magnetic layer has reached a predetermined thickness. Then, as shown in FIG. 6F, a plurality of conductive patterns 62B are provided in parallel on the magnetic layer 61C. The conductors, which are filled in the through-holes, connect the conductive patterns 62B to the conductive patterns 62A. The plurality of parallel conductive patterns 62A, the plurality of parallel conductive patterns 62B, and the conductors which are filled in the through-holes, together constitute a spiral coil pattern, the axis of the spiral coil being parallel to the mount face.

Figure 6G:
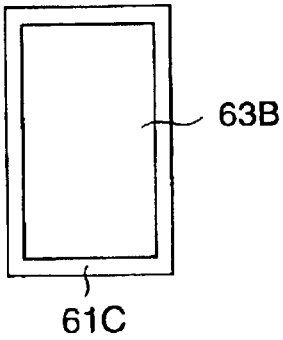

Then, as shown in FIG. 6G, a non-magnetic layer 63B is provided on the top face of the magnetic layer 61C excepting the peripheral portions thereof.

Figure 6H:
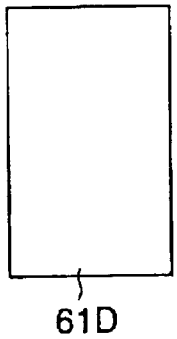
Figure 7:
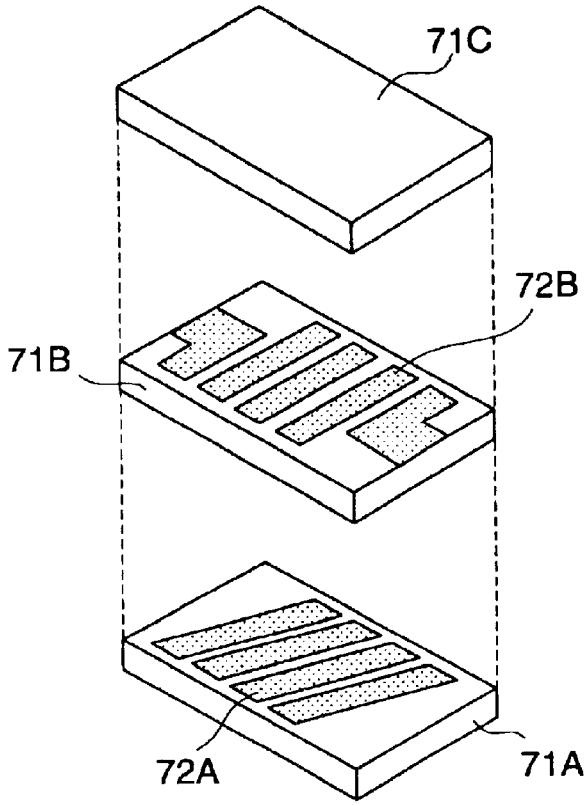
FIG. 7 is an exploded perspective view of a conventional laminated electronic component.
Figure 8A:
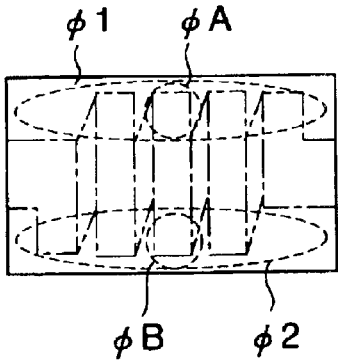
FIGS. 8A and 8B are cross-sectional views of FIG. 7.
Figure 8B:
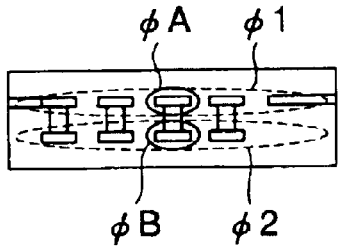

Then, as shown in FIG. 6H, a magnetic layer 61D is provided over the entire top faces of the non-magnetic layer and the portions of the magnetic layer which are exposed from the non-magnetic layer.

The laminated electronic component and manufacturing method according to this invention are not restricted to the embodiments described above. For example, in the first embodiment, the through-holes may be provided in the non-magnetic layer by printing a paste of non-magnetic ceramic inside the grooves at positions corresponding to the ends of the conductive patterns. The conductors may be provided in the through-holes prior to printing the conductive patterns.

In the second embodiment, the through-holes may be provided in the non-magnetic section by laser processing after the paste of non-magnetic ceramic has been printed inside the grooves. Moreover, the non-magnetic section may be provided after laminating a plurality of magnetic bodies on the non-magnetic layer, by providing a pair of grooves at positions corresponding to the ends of the conductive patterns and extending parallel to the axis of the coil, and printing the non-magnetic ceramic paste in the grooves.

In the laminated electronic component of this invention described above, the magnetic layer is provided between the plurality of first conductive patterns and the plurality of second conductive patterns, and comprises non-magnetic sections, which are provided at positions corresponding to ends of the conductive patterns and extend parallel to the axis of the coil. Consequently, the non-magnetic section prevents any magnetic flux from flowing between conductors in the through-holes, which connect the first conductive patterns to the second conductive patterns. Therefore, the laminated electronic component of this invention can obtain a large inductance without leaked flux.

Furthermore, the laminated electronic component manufacturing method of this invention comprises a first step of printing a plurality of first conductive patterns in parallel on a top face of a first non-magnetic layer on a first magnetic layer; a second step of providing a second magnetic layer over the entire top face of the first non-magnetic layer, which the first conductive patterns are provided on, and providing a pair of grooves at positions corresponding to ends of the first conductive patterns on the second magnetic layer by laser processing, the pair of grooves extending parallel to the axis of the coil; a third step of providing non-magnetic sections having through-holes at positions corresponding to the ends of the first conductive patterns in the pair of grooves; a fourth step of printing a plurality of second conductive patterns on the top face of the second magnetic layer, which the non-magnetic sections are provided on, the plurality of second conductive patterns being arranged in parallel so that the first conductive patterns are alternately connected thereto via the through-holes, thereby forming a spiral coil pattern; and a fifth step of sequentially providing a second non-magnetic layer and a third magnetic layer on the second magnetic layer, which the non-magnetic sections and the second conductive patterns are provided on. Consequently, the non-magnetic layers and the non-magnetic sections prevent magnetic flux from flowing between conductors in the through-holes, which connect the first conductive patterns to the second conductive patterns, and between the conductive patterns. Therefore, the laminated electronic component manufacturing method of this invention can obtain a large inductance without leaked flux.

Further, the laminated electronic component manufacturing method of this invention comprises providing a second magnetic layer on the entire top face of the first non-magnetic layer, which the first conductive patterns are provided on, and thereafter, providing by laser processing a pair of grooves at positions corresponding to the ends of the first conductive patterns on the second magnetic layer, the pair of grooves extending parallel to the axis of the coil.

Therefore, the printing face can be made flat and, in addition, the effects of printing stains can be reduced, and the first and second conductive patterns can be properly connected.

What is claimed is:

1. A method for manufacturing a laminated electronic component comprising a plurality of parallel first conductive patterns, which are laminated via a magnetic layer to a plurality of parallel second conductive patterns, the first and second conductive patterns being alternately connected to each other via through-holes, thereby forming a spiral coil inside a laminated body, the axis of the spiral coil being parallel to a mount face, the method comprising:

a first step of printing a plurality of first conductive patterns in parallel on a top face of a first non-magnetic layer on a first magnetic layer;

a second step of providing a second magnetic layer over the entire top face of the first non-magnetic layer, which the first conductive patterns are provided on, and providing a pair of grooves at positions corresponding to ends of the first conductive patterns on the second magnetic layer by laser processing, the pair of grooves extending parallel to the axis of the coil;

a third step of providing non-magnetic sections having through-holes at positions corresponding to the ends of the first conductive patterns in the pair of grooves;

a fourth step of printing a plurality of second conductive patterns on the top face of the second magnetic layer, which the non-magnetic sections are provided on, the plurality of second conductive patterns being arranged in parallel so that the first conductive patterns are alternately connected thereto via the through-holes, thereby forming a spiral coil pattern; and a fifth step of sequentially providing a second non-magnetic layer and a third magnetic layer on the second magnetic layer, which the non-magnetic sections and the second conductive patterns are provided on.

2. The laminated electronic component manufacturing method according to claim 1, wherein the through-holes of the third step are provided at the time of printing the non-magnetic sections in the pair of grooves.

3. The laminated electronic component manufacturing method according to claim 1, wherein the through-holes of the third step are provided by laser processing.

4. A method for manufacturing a laminated electronic component comprising a plurality of parallel first conductive patterns, which are laminated via a magnetic layer to a plurality of parallel second conductive patterns, the first and second conductive patterns being alternately connected to each other via through-holes, thereby forming a spiral coil inside a laminated body, the axis of the spiral coil being parallel to a mount face, the method comprising:

a first step of printing a plurality of first conductive patterns in parallel on a top face of a first non-magnetic layer on a first magnetic layer;

a second step of providing a plurality of second magnetic layers over the entire top face of the first non-magnetic layer, which the first conductive patterns are provided on, and providing a pair of grooves at positions corresponding to ends of the first conductive patterns on the second magnetic layer by laser processing, the pair of grooves extending parallel to the axis of the coil;

a third step of providing non-magnetic sections having through-holes at positions corresponding to the ends of the first conductive patterns in the pair of grooves;

a fourth step of printing a plurality of second conductive patterns on the top face of the second magnetic layer, which the non-magnetic sections are provided on, the plurality of second conductive patterns being arranged in parallel so that the first conductive patterns are alternately connected thereto via the through-holes, thereby forming a spiral coil pattern; and a fifth step of sequentially providing a second non-magnetic layer and a third magnetic layer on the second magnetic layer, which the non-magnetic sections and the second conductive patterns are provided on.

5. The laminated electronic component manufacturing method according to claim 4, wherein the through-holes of the third step are provided at the time of printing the non-magnetic sections in the pair of grooves.

6. The laminated electronic component manufacturing method according to claim 4, wherein the through-holes of the third step are provided by laser processing.

7. A method for manufacturing a laminated electronic component comprising a plurality of parallel first conductive patterns, which are laminated via a magnetic layer to a plurality of parallel second conductive patterns, the first and second conductive patterns being alternately connected to each other via through-holes, thereby forming a spiral coil inside a laminated body, the axis of the spiral coil being parallel to a mount face, the method comprising:

a first step of printing a plurality of first conductive patterns in parallel on a top face of a first non-magnetic layer, which is provided on a first magnetic layer;

a second step of providing a plurality of second magnetic layers having non-magnetic sections by repeatedly performing the sequential processes of providing a second magnetic layer over the entire top face of the first non-magnetic layer, which the first conductive patterns are provided on, providing a pair of grooves at positions corresponding to ends of the first conductive patterns on the second magnetic layer by laser processing, the pair of grooves extending parallel to the axis of the coil, providing non-magnetic sections having through-holes at positions corresponding to the ends of the first conductive patterns in the pair of grooves, and filling the through-holes with conductive material;

a third step of printing a plurality of second conductive patterns on the top face of the second magnetic layers having the non-magnetic sections, the plurality of second conductive patterns being arranged in parallel so that the first conductive patterns are alternately connected thereto via the through-holes, thereby forming a spiral coil pattern; and a fourth step of sequentially providing a second non-magnetic layer and a third magnetic layer on the second magnetic layer, which the non-magnetic sections and the second conductive patterns are provided on.

8. The laminated electronic component manufacturing method according to claim 7, wherein the through-holes of the third step are provided at the time of printing the non-magnetic sections in the pair of grooves.

9. The laminated electronic component manufacturing method according to claim 7, wherein the through-holes of the third step are provided by laser processing.

* * * * *